US010894176B2

(12) United States Patent
Derrick et al.

(10) Patent No.: US 10,894,176 B2
(45) Date of Patent: Jan. 19, 2021

(54) GARMENT INCLUDING A GARMENT PORT

(71) Applicant: W. L. Gore & Associates, Inc., Newark, DE (US)

(72) Inventors: Christopher P. Derrick, Flagstaff, AZ (US); Eric C. Gilmore, Flagstaff, AZ (US)

(73) Assignee: W. L. Gore & Associates, Inc., Newark, DE (US)

( * ) Notice: Subject to any disclaimer, the term of this patent is extended or adjusted under 35 U.S.C. 154(b) by 112 days.

(21) Appl. No.: 16/123,841

(22) Filed: Sep. 6, 2018

(65) Prior Publication Data

US 2020/0078616 A1 Mar. 12, 2020

(51) Int. Cl.
*A62B 35/00* (2006.01)

(52) U.S. Cl.
CPC ..... *A62B 35/0025* (2013.01); *A62B 35/0037* (2013.01); *A62B 35/0043* (2013.01); *A62B 35/0056* (2013.01)

(58) Field of Classification Search
CPC ..... A62B 35/0025; A62B 35/0043; A62B 35/0037; A62B 35/0056
See application file for complete search history.

(56) References Cited

U.S. PATENT DOCUMENTS

| | | | | |
|---|---|---|---|---|
| 8,375,467 | B2 * | 2/2013 | Real | A41D 13/0007 2/69 |
| 8,776,266 | B1 * | 7/2014 | Metz | A41D 13/0007 2/93 |
| 2004/0163156 | A1 * | 8/2004 | Schweer | A41D 13/0007 2/69 |
| 2007/0044197 | A1 * | 3/2007 | Turcotte | A41D 13/0007 2/69 |
| 2008/0164095 | A1 * | 7/2008 | Snedeker | A41D 13/0007 182/3 |
| 2008/0289083 | A1 * | 11/2008 | Grilliot | A62B 35/0025 2/271 |
| 2011/0030118 | A1 * | 2/2011 | Pratchett | A41D 13/0007 2/81 |
| 2017/0001049 | A1 * | 1/2017 | Zeppetella | A62B 35/0006 |
| 2019/0216142 | A1 * | 7/2019 | Zeppetella | A62B 35/0037 |

* cited by examiner

*Primary Examiner* — Khaled Annis
(74) *Attorney, Agent, or Firm* — Greenberg Traurig, LLP

(57) ABSTRACT

A garment having an inner surface and an outer surface for use with a safety strap, the garment comprising a collar configured to at least partially encircle an upper portion of the garment, a garment port arranged on or adjacent to the collar forming a channel between the inner surface and the outer surface of the garment, the garment port having at least three sides, one of the sides being open to form the channel, a flap coupled to the collar and configured to move between a closed configuration covering the port and allowing passage of the safety strap through the channel between the inner surface and the outer surface of the garment and an open configuration allowing removal of the safety strap through the open side of the port, and a closure device arranged with the flap and configured to maintain the flap in the closed configuration.

19 Claims, 6 Drawing Sheets

GARMENT INCLUDING A GARMENT PORT

FIELD

The present disclosure relates generally to garments, and more specifically to garments including a garment port compatible for use with a safety harness, and associated methods thereof.

BACKGROUND

Certain activities performed at elevation can include use of a safety harness to protect the wearer from falls. Examples of such activities can include daily elevated work, such as utility work, construction work, and other such work, as well as recreational activities such as hunting (e.g., deer hunting and, in particular, whitetail deer hunting, or any other type of hunting from an elevated position such as when a tree stand is used). A person performing such elevated activities, such as a hunter, may wear the safety harness underneath his clothing. An end of a safety strap is then attached to the safety harness and another end is attached to an anchor point (e.g., a tree, tree stand, utility pole, or other stable object) to protect the wearer from potential falls.

A person wearing or operating the safety harness may have multiple layers of garments or clothing based on the environmental conditions. Due to changing environmental conditions (or other factors), the person may want to remove or add layers of garments. In some conventional garments, the safety harness must be untethered from the anchor point in order to add or remove the garment layer and, only after the garment layer is added or removed, can a user reattach to the anchor point. This removal from the anchor point can increase the likelihood of a fall from the elevated position. In other conventional garments, the safety harness tether exits the garment above the top of the collar and against the wearer's neck which is uncomfortable. With this type of garment, the wearer may add and remove layers of garments, but the harness and tether are uncomfortable, decreasing the likelihood that the safety equipment will be used.

SUMMARY

According to one example ("Example 1"), a garment has an inner surface and an outer surface and is usable with a safety strap. The garment includes a collar configured to at least partially encircle an upper portion of the garment. The garment also includes a garment port arranged on or adjacent to the collar and forming a channel between the inner surface and the outer surface of the garment. The garment port has at least three sides. One of the sides is open to form the channel. The garment also includes a flap coupled to the collar and configured to move between a closed configuration, which covers the garment port and allows passage of the safety strap through the channel between the inner surface and the outer surface of the garment, and an open configuration, which allows removal of the safety strap through the garment port. The garment also includes a closure device arranged with the flap and configured to maintain the flap in the closed configuration.

According to another example ("Example 2") further to Example 1, the closure device includes at least one of a snap, a zipper, a hook and loop fastener, a magnetic closure, and a button.

According to another example ("Example 3") further to Example 2, the closure device includes a snap arranged on a side portion of the flap and a magnetic closure arranged along a bottom portion of the flap.

According to another example ("Example 4") further to Example 1, the flap is configured to form a hinge with a lateral portion of the collar and swing open at least partially circumferentially relative to the collar.

According to another example ("Example 5") further to Example 1, the flap is one of a pentagon, a square, a rectangle, an oval or a trapezoid.

According to another example ("Example 6") further to Example 1, the channel forms a shape with at least one open side. The at least one open side is arranged along a top surface of the collar.

According to another example ("Example 7") further to Example 1, a bottom portion of the flap is straight, triangular, ovular, or circular.

According to another example ("Example 8") further to Example 1, the garment is one of a jacket, a shirt, or a vest.

According to another example ("Example 9") further to Example 1, the garment also includes a hood. The hood is removably coupled to at least a portion of the top surface of the collar but is not coupled to the flap.

According to another example ("Example 10") further to Example 1, the flap comprises a first side, a second side, a top side, and a bottom side. The bottom side is open and forms the passageway.

According to another example ("Example 11"), a garment includes a channel forming an opening between an inner surface and an outer surface of the garment. The channel forms a shape with at least one open side. The garment also includes a flap coupled to the channel and configured to move between an open configuration allowing access to the channel and a closed configuration covering the channel.

According to another example ("Example 12") further to Example 11, the garment also includes a first closure device arranged along a lower portion of the flap and a second closure device along another portion of the flap.

According to another example ("Example 13") further to Example 12, the first closure device comprises at least one of a snap, a zipper, a hook and loop fastener, a magnetic closure, and a button.

According to another example ("Example 14") further to Example 11, the garment also includes an insulating strip oriented along a bottom surface of the collar and arranged underneath the flap.

According to another example ("Example 15") further to Example 11, a bottom portion of the flap is aligned with the bottom surface of the collar.

According to another example ("Example 16") further to Example 11, the bottom portion of the flap extends below the bottom surface of the collar.

According to another example ("Example 17") further to Example 11, the garment also includes a magnetic strip oriented along at least a portion of the flap.

According to another example ("Example 18"), a method for forming a garment having a garment port includes forming a flap in the garment. The flap is configured to move between an open configuration allowing access to the garment port and a closed configuration covering the garment port and forming a channel. The channel forms a shape with at least one open side. The channel allows passage between an inner surface and an outer surface of the garment. The flap is configured to move between the open configuration to allow for routing of a safety strap through the garment port without removal of the garment from a wearer and a closed configuration covering the garment port.

According to another example ("Example 19") further to Example 18, the method also includes attaching a closure device to the flap to maintain the flap in the closed configuration.

According to another example ("Example 20") further to Example 18, when the flap is in the closed configuration, the safety strap is routed through the channel.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Figure 1:
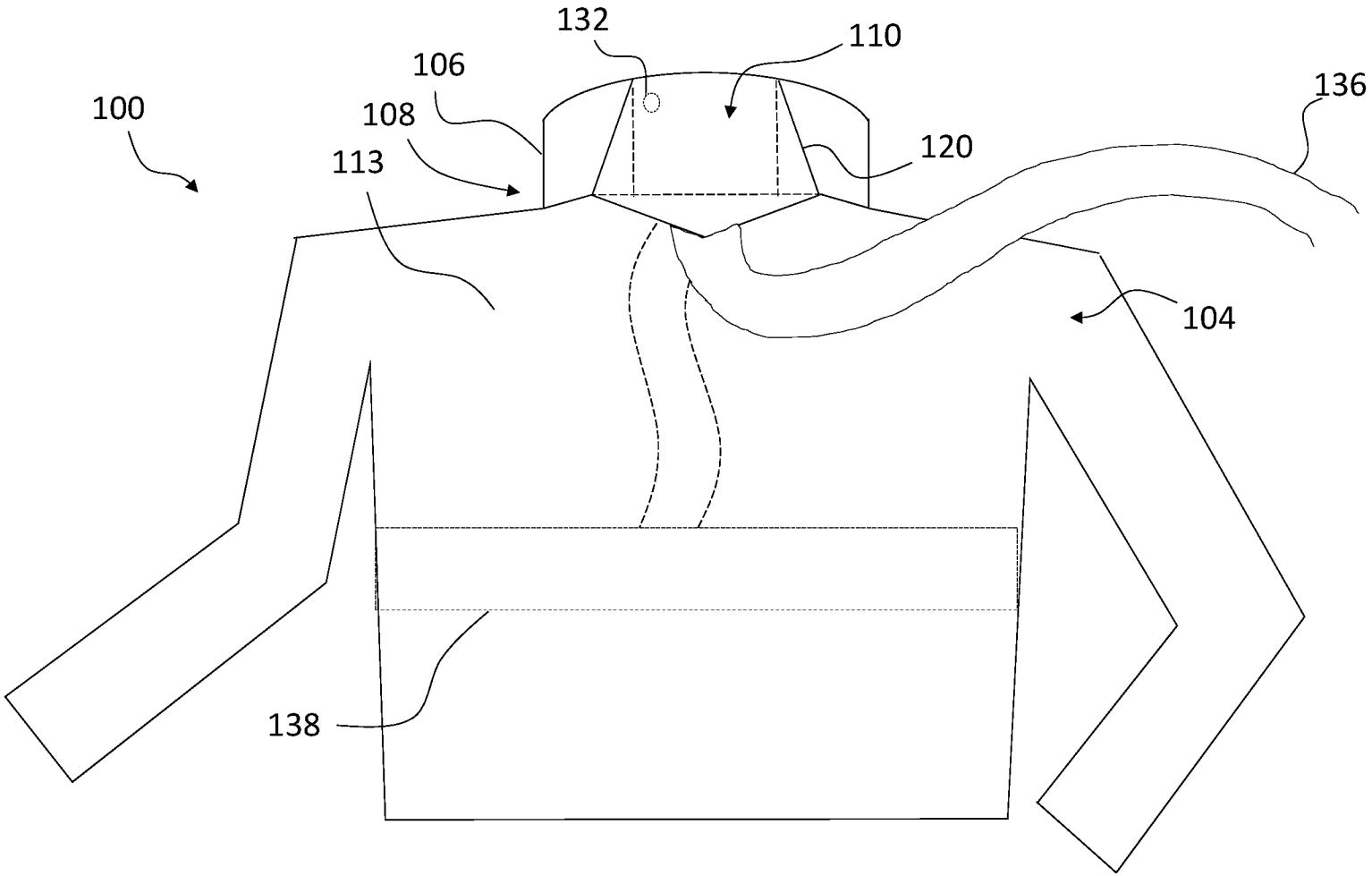
FIG. 1 is a schematic view of a garment including a garment port, in accordance with certain embodiments.

Persons skilled in the art will readily appreciate that various aspects of the present disclosure can be realized by any number of methods and apparatus configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

Various aspects of the present disclosure are directed toward garments that enable a wearer to add or remove a layer of clothing while the wearer remains attached in an elevated position and safely anchored to the elevated position via a safety harness, a safety strap and an anchor point. The wearer is not required to detach the safety strap from the anchor point or from the harness in order to add or remove the garment while the safety harness remains connected to the safety strap and anchor point. In this manner, the garment allows for efficient and quick donning or removal of the garment without jeopardizing the wearer's safety by requiring detachment from the safety strap. Prior garments that are designed to be compatible with harnesses and safety straps do not enable efficient and quick donning or removal of the garment without jeopardizing the wearer's safety. For example, garments that include a hole or slit in the garment (e.g., at the wearer's mid-back, upper back, or shoulder area) for the safety strap to pass through require that the user detach the safety strap when donning or removing the garment. The garments discussed herein enable continuous use of a tethered safety harness while enabling safe, quick, and efficient donning and removal of garments.

As used herein, the phrase "safety harness" means a device worn by a wearer when in an elevated position to protect the wearer from falls. In some instances, the safety harness encircles one or more of the user's shoulders, torso and/or legs. The phrase "safety strap" or "strap" means a relatively strong tether that is permanently or releasably attached to the safety harness or to the anchor point. The phrase "anchor point" is a device that is permanently or releasably attached to an elevated structure, for example, a tree or a scaffold. In some embodiments, the safety harness and the safety strap are permanently attached to one another and the safety strap and the anchor point are able to connect to one another, for example, by a loop in the safety strap and a carabineer on the anchor point so that the safety strap and the anchor point can be attached and detached relatively easily. In other embodiments, the safety strap can be permanently attached to the anchor point and the safety strap and the safety harness can be releasably coupled to each other. The described safety harness, safety strap and anchor point are able to bear the weight of the wearer so that, if the wearer slips or falls from an elevated position, the wearer falls only a short distance, for example, a few centimeters to less than one meter, and the threat of injury from the fall is minimized or eliminated.

As discussed above, efficient removal of garments is beneficial during a variety of activities, such as activities in which the wearer's safety depends upon attachment to an anchor point via a safety harness and strap. One specific example is that of a hunter wearing a tree stand safety harness. Certain types of hunting (i.e., deer hunting and, in particular, whitetail deer hunting) are commonly performed in tree stands. Thus, to ensure the safety of the wearer and protect from falls, the hunter may wear a safety harness, such as a shoulder harness or a full-body harness, underneath outer garments or various layers of clothing such as jackets, mid-layers, insulating layers, and waterproof or water-resistant layers, among others.

The hunter may wear multiple layers of clothing (i.e., multiple jackets, a mid-layer and a jacket, and other combinations) and may desire to add or remove garments throughout the day for increased comfort and/or functionality in response to changing environmental conditions. The garment of the present disclosure allows the hunter, for example, to add or remove layers while remaining attached to the safety strap and anchor point. The garment also allows for quick and easy donning or removal of layers, thus improving the speed at which the hunter can safely add and remove the garment. Because the hunter is not required to detach from the safety strap and anchor point, the hunter does not increase his or her risk of falling by adding or removing layers of clothing.

The present disclosure relates to a garment having an inner surface and an outer surface, for use with a safety strap, the garment comprising a collar configured to at least partially encircle an upper portion of the garment; a garment port arranged on or adjacent to the collar and forming a channel between the inner and outer surface of the garment, the garment port having at least three side, one of the sides being open to form the channel; a flap coupled to the collar and configured to move between a closed configuration covering the garment port and allowing passage of the safety strap through the channel between the inner and outer surface of the garment and an open configuration allowing for movement of the safety strap through the garment port; and a closure device arranged with the flap and configured to maintain the flap in the closed configuration. In other embodiments, the garment comprises a channel forming an opening between an inner surface and an outer surface of the garment, the channel forming a shape with at least one open side; and a flap coupled to the channel and configured to move between an open configuration to allow access to the channel and a closed position covering the channel.

FIG. 1 is a schematic view of the garment 100 including a garment port 110, according to certain embodiments. The garment 100 generally includes a collar 106, a garment port 110 arranged on or adjacent to the collar 106, a flap 120 coupled to the collar 106, and a closure device 132 arranged with the flap 120. The collar 106 is configured to at least partially encircle an upper portion 108 of the garment 100. For example, in use, the collar 106 may be configured to at least partially encircle a neck of the wearer or, in some instances may completely encircle the neck of the wearer.

In some embodiments, the body portion 113 of the garment 100 includes an inner surface (not shown) and an outer surface 104. In some embodiments (i.e., where the garment 100 is a coat or jacket), the inner surface of the garment contacts the wearer of the garment or another layer of clothing worn by the wearer, for example, a mid-layer. The outer surface 104 of the garment is directly exposed to the environment. In other embodiments (i.e., where the garment 100 is a mid-layer, for example), the outer surface 104 of the garment may contact an additional layer of clothing worn outside of the mid-layer.

Though the garment 100 shown in FIG. 1 is a jacket, the garment 100 can be any type of clothing. For example, the garment 100 may be a jacket, a coat, a vest, a sweater, a shirt, or rainwear, among others. Additionally, the garment 100 may serve any of a variety of purposes. For example, the garment 100 may be an outer-layer, a mid-layer, an insulating layer, a protective layer, and/or a waterproof or water-resistant layer, with or without a hood.

Figure 4:
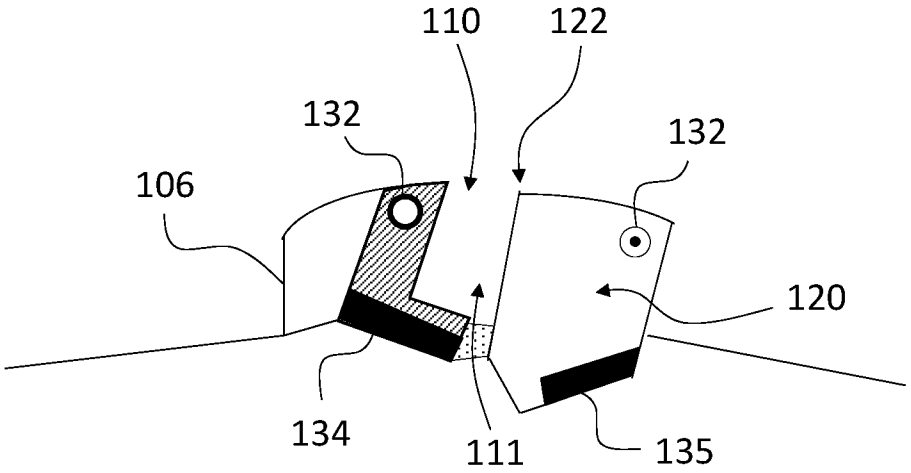
FIG. 4 is a schematic view of a garment port in an open configuration, in accordance with certain embodiments.

As shown in FIGS. 1 and 4, the flap 120, in the open configuration, allows for a safety strap 136 to be passed through the garment 100 between the inner surface and the outer surface 104 of the garment 100 via the garment port 110 so that the strap 136 can be attached to a safety harness 138. As discussed above, the safety harness 138 is worn underneath the garment 100 and a first end of the strap 136 passes through the garment 100 (e.g., from the outer surface 104 to the inner surface) to attach to the safety harness 138. A second end of the strap 136 is then attached to an anchor point (i.e., a tree, a tree stand, or any other stable object).

Figure 2:
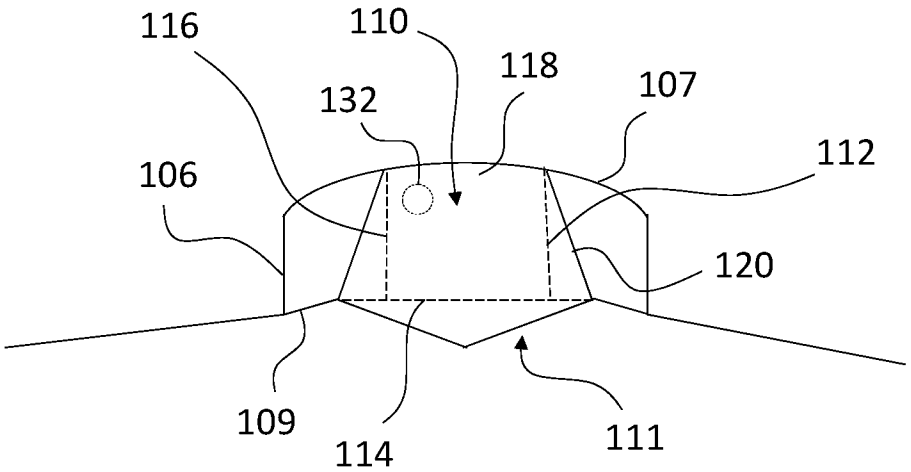
FIG. 2 is a schematic view of garment port, in accordance with certain embodiments.

FIG. 2 is a schematic view of the garment port 110, according to certain embodiments. As shown, the garment port 110 is arranged on or adjacent to the collar 106. For example, the garment port 110 may be a gap, an opening, or any other such passageway that provides a route for passing an article (e.g., the safety strap) through the garment 100.

The garment port 110 can be any of a variety of shapes. For example, the garment port 110 can be square, rectangular, triangular, or any other shape as desired. In some examples, the garment port 110 may simply be a gap between portions of the collar. In other examples, the garment port 110 may be a cut-out or shape formed into the collar. In various examples, the garment port 110 may have at least three sides (e.g., a first side 112, a second side 114, and a third side 116), while in other examples, the garment port 110 may have four sides (e.g., a first side 112, a second side 114, and a third side 116, and a fourth side 118), or the garment port 110 may have more than four sides. At least one of the sides of the garment port 110 is open to form the channel 111 between the inner surface and the outer surface 104 of the garment 100. In some embodiments, the bottom portion of the collar, for example, side 114 of the garment port 110 remains open or unattached to the garment to form the channel 111. However, any of the sides could be open to form the channel 111. Detachment of a strap 136 from a safety harness 138 or anchor point presents various safety risks if the wearer is elevated when donning or removing the garment. The garment port 110 having at least one open side to form the channel 111 allows for donning and removing of the garment without detachment of the strap 138 from the safety harness 138 or anchor point. The strap 138 can pass freely through the garment port 110 while the wearer is removing or adding the garment 100.

The garment further comprises a flap 120 that is coupled to the collar 106. The flap 120 is configured to move between an open configuration and a closed configuration (as shown in FIG. 2). For example, the open configuration (shown in FIG. 4) allows the safety strap to move through the garment port 110 when donning or removing the garment. In the closed position, the flap 120 covers the garment port 110 allowing the safety strap a passageway through the garment via the channel 111. In some embodiments, the flap 120 may cover the channel 111 while still allowing an article (i.e., the safety strap) to be passed through the garment port 110. For example, the safety strap can remain attached to the safety harness as well as the anchor point while the flap 120 is in the closed configuration.

Figure 3A:
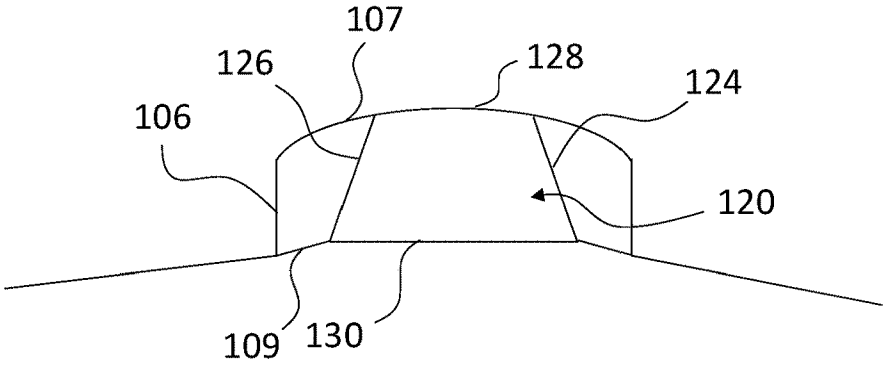
FIG. 3A-3C are schematic views of garment port configurations, in accordance with certain embodiments.
Figure 3B:
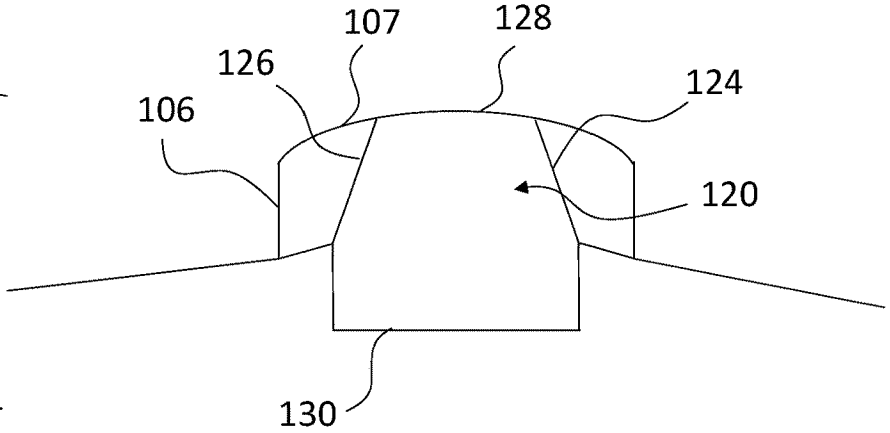
Figure 3C:
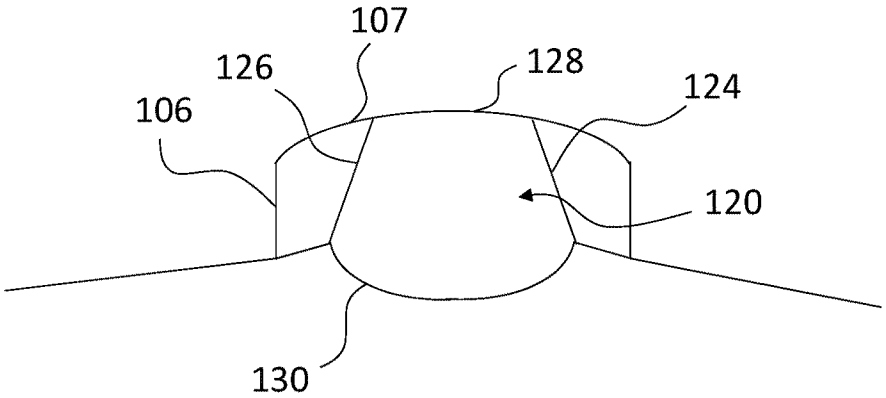

FIGS. 3A-3C are schematic views of various flap 120 shapes, according to some embodiments. As shown, the flap 120 can be any of a variety of shapes. For example, the flap 120 can be square, rectangular, trapezoidal, pentagonal, hexagonal, triangular, an oval or any other shape as desired. In some embodiments, the flap 120 can be one of a pentagon, a square, a rectangle, an oval, a trapezoid or a hexagon. In some examples, the flap 120 has four sides (e.g., a first side 124, a second side 126, and a top side 128, and a bottom side 130). As shown in FIGS. 3A-3C, the top side 128 may be in line with the top surface 107 of the collar 106 when the flap 120 is in the closed configuration. In some examples, the bottom side 130 may be substantially straight and in line with the bottom surface 109 of the collar 106 as shown in FIG. 3A. In other examples, the bottom side 130 may extend below the bottom surface 109 of the collar 106 and can be triangular (FIG. 2), squared (FIG. 3B), rounded (FIG. 3C) or any other shape as desired. In other embodiments, the bottom portion of the flap can be straight, triangular, ovular or circular.

The flap 120 also includes a top portion 128 and a bottom portion 130. In some embodiments, the bottom portion 130 of the flap 120 extends below the bottom surface 109 of the collar 106, as shown in FIGS. 3B and 3C thereby covering the channel. The bottom portion 130 of the flap 120 can overlap a portion of the body portion 113 of the garment 100. This overlap can provide for improved insulation and weather-proofing of the garment 100 by ensuring complete coverage of the garment port 110 and the channel.

FIG. 4 is a schematic view of a garment flap 120 in an open configuration, according to some embodiments. As shown, an edge of the flap 120 can form a hinge 122 with a lateral portion of the collar 106 such that the hinge allows the flap 120 to move between the open configuration (as shown in FIG. 4) and a closed configuration at least partially circumferentially relative to the collar 106. In some examples, the flap 120 is attached to the collar 106 at a portion of the collar 106 that is near the garment port 110. For example, the hinge 122, formed by fabric of the collar 106 and the flap 120, can be arranged at the first side 112 of the garment port 110 such that the flap 120 swings open from left to right. In other examples, the hinge 122 can be attached at the second side 116 the garment port 110 such that the flap 120 swings open from right to left. Thus, different types of garments may be designed to hinge open in different directions. For example, a mid-layer may swing open from left to right while an outer-layer swings open from right to left and vice versa. Thus, if a mid-layer is worn under an outer-layer, opposite hinging allows the collar 106 to lay flatter, which may provide increased comfort to the wearer.

In some embodiments, the flap 120 may be integral with the collar 106. In other terms, the flap 120 is part of the collar 106 and, more specifically, is a portion or strip of the collar 106 that extends over the garment port 110. In other embodiments, the flap 120 can be a separate portion, for example, a completely removable portion that is removably attached to the collar 106 on both sides of the flap 120. The flap 120 may be removably attached to the collar, for example, by one or more of a snap, a button, a zipper, a hook and loop fastener, a magnetic closure, or a combination thereof.

In some embodiments, a closure device 132 is arranged with the flap 120 and is configured to maintain the flap 120 in the closed configuration. The closure device 132 may include one or more suitable closure devices, for example, a snap, a button, a zipper, a hook and loop fastener, a magnetic closure, or a combination thereof.

The closure device 132 may be arranged on the flap 120 near one of the sides of the flap 120. For example, the closure device 132 may be arranged near the first side 124 or the second side 126. In some embodiments, the closure device 132 is located on the opposite side of the flap 120 as the hinge 122. For example, if the hinge 122 is located on the first side 124 of the flap 120, the closure device 132 may be located on the second side 126 and vice versa. In some embodiments, the closure device includes a snap arranged on a side portion of the flap and a magnetic closure arranged along a bottom portion of the flap. In still further embodiments, a first closure device is arranged along a lower portion of the flap and a second closure device along another portion of the flap.

In some embodiments, the flap 120 includes more than one closure device, as shown in FIG. 4. For example, the flap 120 can include a first closure device 132 and a second closure device 134. The first and second closure devices 132, 134 can be the same type of closure. For example, both closure devices 132, 134 can comprise magnetic strips 135 located on different portions of the flap 120. In other examples, the first and second closure devices 132, 134 can be different types of closures. For example, as shown in FIG. 4, the first closure device 132 may be a snap arranged on a side portion of the garment (e.g., the first side 124 or the second side 126) and the second closure device 134 may be a magnetic strip or other type of closure arranged along the bottom portion of the flap 120.

As shown in FIG. 4, the garment port 110 forms an opening along the collar 106 through which a safety strap can pass while a person is adding or removing the garment. When the flap 120 is in the open configuration, the garment port 110 enables the person to remove or add the garment without detaching the safety strap from the safety harness or from the anchor point. In this manner, the garment allows for efficient and quick donning or removal of the garment without jeopardizing the wearer's safety by requiring detachment of the safety strap. The flap 120, the channel 111 and the garment port 110 may be positioned along another portion of the garment separate from the collar 106. In some embodiments, the flap 120, the channel and the garment port 110 may be positioned, for example, along a bottom edge of the garment with the channel 111 or opening being formed in line with the bottom edge of the garment.

Figure 5:
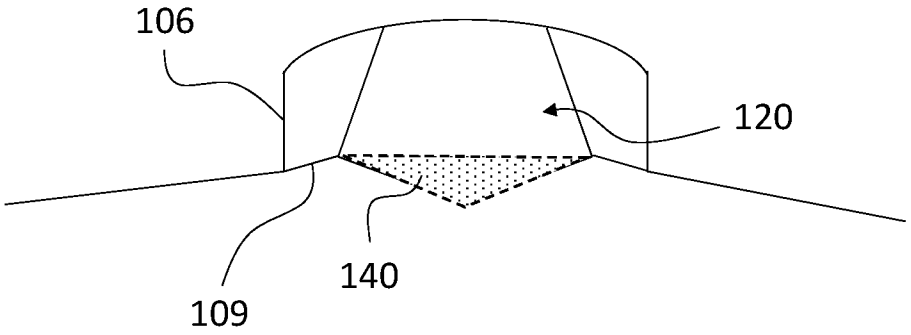
FIG. 5 is a schematic view of a garment port including an insulating strip, in accordance with certain embodiments.

FIG. 5 is a schematic view of the flap 120 in a closed configuration and including an insulating strip 140, according to some embodiments. The insulating strip 140 can be oriented along the bottom surface 109 of the collar 106 (i.e., where the collar 106 meets the body portion 113 of the garment 100) and, in particular, along a portion of the garment port 110. For example, the insulating strip 140 can be arranged underneath the flap 120 to prevent or minimize cold air and/or moisture from entering the garment port 110 and/or the channel. In other embodiments, the insulating strip 140 can comprise at least a portion of the flap, for example, a bottom portion of the flap 120 thereby preventing or minimizing cold air and/or moisture from entering the garment port 110 and/or the channel.

In some embodiments, the insulating strip 140 is a narrow strip of insulating material or fabric capable of preventing cold air and/or moisture from entering the garment port 110. In other terms, the insulating strip 140 may form a seal between the garment port 110 and the flap 120. Examples of suitable insulating materials include, for example, down, foam, synthetic insulation, available from 3M, St. Paul, Minn., synthetic insulation blended with down, synthetic insulation blended with wool or other natural fibers, wool, cotton, or a combination thereof. Any known garment insulation may be used.

Figure 6:
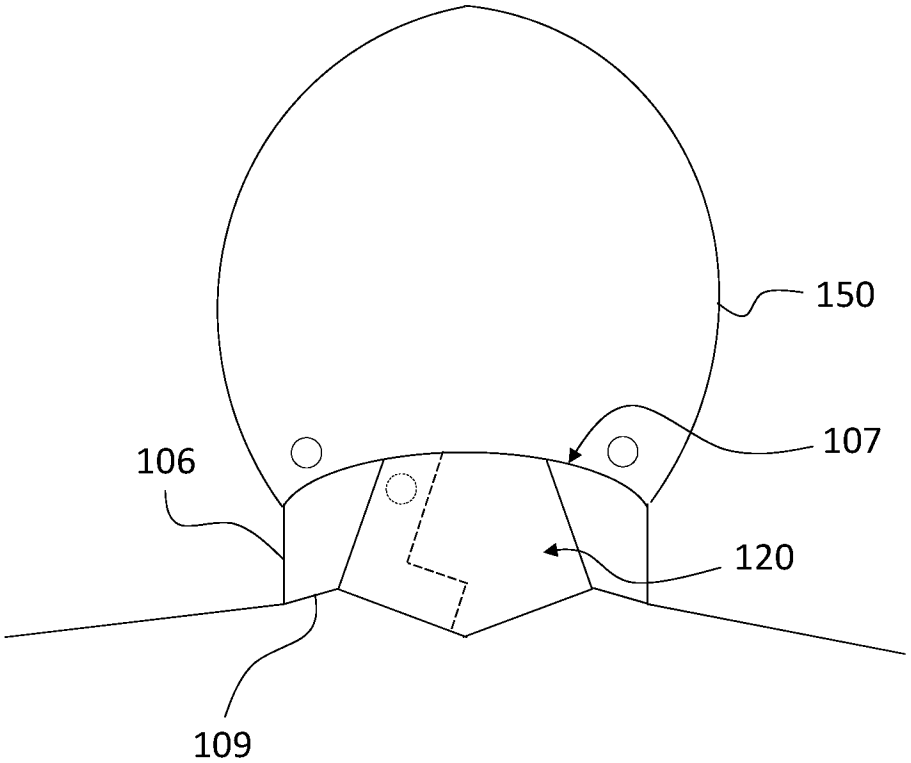
FIG. 6 is a schematic view of a garment port on a garment including a hood, in accordance with certain embodiments.

FIG. 6 is a schematic view of the garment 100 having a hood 150, according to some embodiments. As shown, the hood 150 is attached to at least a portion of the top surface 107 of the collar 106. For example, the hood 150 may be attached to certain portions of the top surface 107 of the collar 106 but not attached to the flap 120. This allows the flap 120 to remain movable between the closed configuration and the open configuration even while the hood 150 is attached.

The hood 150 can be attached to the collar 106 in a variety of ways. In some examples, the hood 150 can be removably attached to the collar 106 such that the hood 150 can be attached and/or removed easily and readily by the wearer. For example, at least a portion of the hood 150 can be detached from the collar 106 such that a safety strap can be passed through the garment port 110. The hood 150 can then be quickly reattached once the safety strap is in place. Examples of suitable attachment devices include one or more of a snap, a zipper, a hook and loop fastener, a magnetic closure, a button or a combination thereof.

The garment 100 disclosed herein can be formed in a variety of ways. In some examples, a method for forming the garment 100 includes forming the garment port 110 and the flap 120 in the garment 100 to provide a channel between the inner surface and the outer surface 104 of the garment 100. As discussed above, the garment port 110 forms a shape having at least one open side. The method also includes coupling a flap 120 to the garment such that the flap 120 covers the garment port 110. The flap 120 can move between the open configuration and the closed configuration to allow for routing of a safety strap through the open side of the channel, for example. Thus, the safety strap can be routed through the channel without the wearer having to remove the garment 100. In other embodiments, the method for forming a garment having a garment port comprises: forming a flap in the garment, the flap configured to move between an open configuration allowing access to the garment port and a closed configuration covering the garment port and forming a channel, the channel forming a shape with at least one open side wherein the channel allows passage between an inner surface and an outer surface of the garment; and the flap being configured to move between an open configuration allowing access to the garment port to allow for routing of a safety strap through the garment port without removal of the garment from a wearer and a closed configuration covering the garment port.

In some embodiments, the method also includes attaching at least one closure device 132 to the flap 120 and to the garment, for example, the collar 106 to optionally maintain the flap 120 in the closed position. In some examples, more than one closure device may be attached. For example, a first closure device 132 and a second closure device 134 may be attached to the flap 120 on different sides of the flap 120 to maintain the flap 120 in the closed position.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A garment comprising:
an inner surface;
an outer surface,
a collar at least partially encircling an upper portion of the garment;
a garment port arranged on the collar,
wherein the garment port comprises a channel extending between the inner surface and the outer surface of the garment,
wherein the garment port comprises at least three sides,
wherein one of the at least three sides is open to an exterior of the garment such that the port is designed to slideably and removably receive a safety strap into the channel via an open side;
a flap coupled to the collar,
wherein the flap is configured to move between:
a) a closed configuration in which the flap covers the garment port and allows passage of the safety strap through the channel between the inner surface and the outer surface of the garment,
wherein when the flap is in the closed configuration, the flap prevents removal of the safety strap through the open side of the channel of the garment port, and
b) an open configuration in which the flap does not prevent removal of the safety strap through the open side of the channel of the garment port; and
a closure device attached to the flap and configured to maintain the flap in the closed configuration.

2. The garment of claim 1, wherein the closure device comprises at least one of a snap, a zipper, a hook and loop fastener, a magnetic closure, and a button.

3. The garment of claim 2, wherein the closure device includes a snap arranged on a side portion of the flap and a magnetic closure arranged along a bottom portion of the flap.

4. The garment of claim 1, wherein the flap is configured to form a hinge with a lateral portion of the collar and swing open at least partially circumferentially relative to the collar.

5. The garment of claim 1, wherein the flap is one of a pentagon, a square, a rectangle, an oval, or a trapezoid.

6. The garment of claim 1, wherein the at least one open side is arranged along a top surface of the collar.

7. The garment of claim 1, wherein a bottom portion of the flap is straight, triangular, ovular, or circular.

8. The garment of claim 1, wherein the garment is one of a jacket, a shirt, or a vest.

9. The garment of claim 1, wherein the garment further comprises a hood, and wherein the hood is removably coupled to at least a portion of the top surface of the collar but is not coupled to the flap.

10. The garment of claim 1, wherein the flap comprises a first side, a second side, a top side, and a bottom side, and wherein the bottom side is open and forms a passageway.

11. A garment, comprising:
an inner surface;
an outer surface,
a collar at least partially encircling an upper portion of the garment;
a garment port arranged on or adjacent to the collar,
wherein the garment port comprises a channel having at least one side wall extending between the inner surface and the outer surface of the garment,
wherein the channel is designed to removably receive a safety strap into the channel via an open side; and
a flap coupled to the channel or the collar,
wherein the flap is configured to move between:
a) an open configuration in which the flap does not prevent removal of the safety strap through the open side of the channel of the garment port, and
b) a closed configuration in which the flap covers the garment port and allows passage of the safety strap through the channel between the inner surface and the outer surface of the garment,
wherein when the flap is in the closed configuration, the flap prevents removal of the safety strap through the open side of the channel of the garment port.

12. The garment of claim 11, further comprising a first closure device arranged along a lower portion of the flap and a second closure device along another portion of the flap.

13. The garment of claim 12, wherein the first closure device comprises at least one of a snap, a zipper, a hook and loop fastener, a magnetic closure, and a button.

14. The garment of claim 11, further comprising an insulating strip oriented along a bottom surface of the collar and arranged underneath the flap.

15. The garment of claim 11, wherein a bottom portion of the flap is aligned with the bottom surface of the collar.

16. The garment of claim 11, wherein the bottom portion of the flap extends below the bottom surface of the collar.

17. The garment of claim 11, further comprising a magnetic strip oriented along at least a portion of the flap.

18. A method for forming a garment, the method comprising:
forming a flap in the garment,
wherein the garment comprises a garment port,
wherein the garment port comprises a channel extending between the inner surface and the outer surface of the garment, wherein the garment port comprises at least one open side open to an exterior of the garment such that the port is configured to slideably and removably receive a safety strap into the channel via the open side,
wherein the flap is configured to move between:
a) an open configuration in which the flap allows access to the garment port, and
b) a closed configuration in which the flap covers the garment port and allows passage of the safety strap through the channel between the inner surface and the outer surface of the garment,
wherein when the flap is in the closed configuration, the flap prevents removal of the safety strap through the open side of the channel of the garment port.

19. The method of claim 18, further comprising attaching a closure device to the flap to maintain the flap in the closed configuration.

* * * * *